US010080931B2

(12) United States Patent
Brunski et al.

(10) Patent No.: US 10,080,931 B2
(45) Date of Patent: Sep. 25, 2018

(54) GOLF CLUB HEAD

(71) Applicant: DUNLOP SPORTS CO., LTD., Kobe-shi, Hyogo (JP)

(72) Inventors: Jeff D. Brunski, Los Angeles, CA (US); Darius Cyrulik, Huntington Beach, CA (US); Matthew R. Daraskavich, Huntington Beach, CA (US); Michael T. Prichard, Huntington Beach, CA (US); Ryan J A. Ritchie, Huntington Beach, CA (US); Michael J. Cohen, Evanston, IL (US)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 382 days.

(21) Appl. No.: 14/677,742

(22) Filed: Apr. 2, 2015

(65) Prior Publication Data

US 2015/0209627 A1 Jul. 30, 2015

Related U.S. Application Data

(63) Continuation of application No. 13/568,741, filed on Aug. 7, 2012, now Pat. No. 9,011,266.

(51) Int. Cl.
*A63B 53/04* (2015.01)
*A63B 60/42* (2015.01)

(52) U.S. Cl.
CPC ..... *A63B 53/04* (2013.01); *A63B 53/047* (2013.01); *A63B 53/0466* (2013.01);
(Continued)

(58) Field of Classification Search
CPC ... A63B 53/04; A63B 53/0466; A63B 53/047; A63B 60/42; A63B 2053/045;
(Continued)

(56) References Cited

U.S. PATENT DOCUMENTS 3,357,219 A * 12/1967 Hunter ..... A63B 60/42 72/297
3,965,714 A * 6/1976 Beard ..... B21D 11/10 72/297

(Continued)

FOREIGN PATENT DOCUMENTS

JP H11-226158 A 8/1999
JP 2000-153008 A 6/2000
JP 2008-279249 A 11/2008

OTHER PUBLICATIONS

Cleveland Golf HiBore wood-type golf club head: http://valueguide.pga.com/detail-exec/brand/2677/product_type/203/model/46521/b/Cleveland/p/Driver/m/Hi-Bore. Oct. 22, 2006.

(Continued)

*Primary Examiner* — Sebastiano Passaniti
(74) *Attorney, Agent, or Firm* — Oliff PLC

(57) ABSTRACT

A golf club head comprises a loft angle no less than 18°, a striking face, a sole portion, and a top portion having an exterior surface. In an imaginary vertical plane spaced from a face center by no more than 10 mm and perpendicular to an imaginary striking face plane, an imaginary line segment has a length of 25 mm, a first endpoint located in the imaginary striking face plane, a second endpoint located above the exterior surface, and forms an angle θ with the striking face plane between 55° and 65°. The line segment is tangent to the exterior surface at a first point. A second point is located on the imaginary line segment and spaced from the first point by no less than 1 mm. The second point is spaced from the exterior surface by a gap distance that is no greater than 0.15 mm.

9 Claims, 18 Drawing Sheets

(52) U.S. Cl.
CPC ..... *A63B 60/42* (2015.10); *A63B 2053/045* (2013.01); *A63B 2053/0408* (2013.01); *A63B 2053/0412* (2013.01); *A63B 2053/0437* (2013.01); *Y10T 29/49764* (2015.01)

(58) Field of Classification Search
CPC .... A63B 2053/0412; A63B 2053/0408; A63B 2053/0437; Y10T 29/49764
USPC ..... 473/324–350, 287–292, 409, 244–248
See application file for complete search history.

(56) References Cited

U.S. PATENT DOCUMENTS

D243,706 S 3/1977 Hall
4,214,754 A 7/1980 Zebelean
4,432,549 A 2/1984 Zebelean
4,630,825 A 12/1986 Schmidt et al.
4,645,207 A 2/1987 Teramoto et al.
4,754,969 A 7/1988 Kobayashi
5,054,784 A 10/1991 Collins
5,056,788 A 10/1991 Katayama
5,092,599 A 3/1992 Okumoto et al.
5,163,682 A 11/1992 Schmidt et al.
5,180,166 A 1/1993 Schmidt et al.
5,221,086 A 6/1993 Antonious
5,255,913 A * 10/1993 Tsuchida ..... A63B 53/04 473/329
5,301,945 A 4/1994 Schmidt et al.
5,318,300 A 6/1994 Schmidt et al.
5,328,175 A 7/1994 Yamada
5,348,302 A 9/1994 Sasamoto et al.
5,398,929 A 3/1995 Kitaichi
5,419,559 A 5/1995 Melanson et al.
5,460,376 A 10/1995 Schmidt et al.
5,470,069 A 11/1995 Schmidt et al.
5,474,296 A 12/1995 Schmidt et al.
5,480,152 A 1/1996 Schmidt et al.
5,482,279 A 1/1996 Antonious
5,584,770 A 12/1996 Jensen
5,611,741 A 3/1997 Schmidt et al.
5,643,112 A 7/1997 Besnard et al.
5,697,853 A 12/1997 Schmidt et al.
5,766,095 A 6/1998 Antonious
5,816,930 A 10/1998 Brawn
5,873,795 A 2/1999 Wozny et al.
6,099,414 A 8/2000 Kusano et al.
D431,852 S 10/2000 Kubica et al.
6,186,903 B1 2/2001 Beebe et al.
6,260,250 B1 7/2001 Hall et al.
D447,783 S 9/2001 Glad
6,319,148 B1 11/2001 Tom
D470,552 S 2/2003 Cleveland et al.
6,533,679 B1 3/2003 McCabe et al.
6,663,506 B2 12/2003 Nishimoto et al.
D484,937 S 1/2004 Madore et al.
7,500,926 B2 3/2009 Rae et al.
7,553,241 B2 6/2009 Park et al.
7,575,524 B2 8/2009 Willett et al.
7,594,862 B2 9/2009 Gilbert
7,651,414 B2 1/2010 Rae et al.
7,758,440 B2 7/2010 Llewellyn et al.
7,815,524 B2 10/2010 Bamber
7,846,039 B2 12/2010 Gilbert et al.
7,938,736 B2 5/2011 Park et al.
7,955,188 B2 6/2011 Bennett et al.
8,337,323 B2 12/2012 Kuan et al.
8,740,723 B2 6/2014 Kuan et al.
9,566,627 B2 * 2/2017 Timmons ..... B21D 3/16
2002/0055396 A1 5/2002 Nishimoto et al.
2002/0107087 A1 8/2002 Fagot
2002/0169035 A1 11/2002 Liu
2004/0204263 A1 10/2004 Fagot et al.
2004/0254030 A1 12/2004 Nishitani et al.
2005/0192119 A1 * 9/2005 Beach ..... A63B 53/0466 473/345
2007/0022799 A1 * 2/2007 Latiri ..... A63B 60/42 72/316
2007/0032308 A1 2/2007 Fagot et al.
2009/0221382 A1 9/2009 Soracco et al.
2010/0317453 A1 12/2010 Cole et al.
2011/0070973 A1 3/2011 Oldknow et al.
2011/0124433 A1 5/2011 Boyd et al.
2012/0149494 A1 6/2012 Takahashi et al.

OTHER PUBLICATIONS

Golfsmith SR-460 driver. Golfsmith® 2007 Clubmaking Catalog, pp. 52-53. Feb. 1, 2007.
Taylor Made Iron Cleeks iron-type golf club heads. http://hotlistgolfdigest.com/detail-exec/brand/2784/product_type/205/model/44127/b/TaylorMade/p/Iron%20set/m/Iron%20Cleek. Dec. 1, 1986.
Adams Golf IDEA A3 OS Hybrid irons. http://www.adamsgolf.com/products/irons/a3os.php. Sep. 9, 2008.

* cited by examiner

GOLF CLUB HEAD

STATEMENT OF RELATED CASES

This is a Continuation of application Ser. No. 13/568,741, filed Aug. 7, 2012. The disclosure of the prior application is hereby incorporated by reference herein in its entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

This invention relates to golf clubs and more particularly golf club heads. Interest among golfers in custom-tailoring their golf equipment has increased over the years. Also, golfers have increasingly demanded golf club heads that include advanced materials, high forgiveness, and generally better performance. However, these desires, i.e. providing easily customizable club heads and high performing club heads, are often incompatible from a design standpoint.

As an example, hollow-type iron club heads have recently become popular for golfers interested in game improvement. Because of their large volume, a significant proportion of the mass of such club heads is located outward from their respective centers of gravity. This increases movement of inertia and, thus, provides for a more forgiving club head on off-centered golf shots. To achieve these characteristics, given a predetermined mass budget, hollow-type iron golf club heads generally include thin-walled construction and comprise different materials throughout the club head body to selectively optimize material properties at various locations. However, as a result of their enlarged shape and thin-walled construction, such golf club heads are ill-suited for use with conventional golf club head customization devices (e.g. the STEELCLUB® Signature Angle Machine by the Mitchell Golf Equipment Company of Dayton, Ohio). As a result, attempts at modifying properties of hollow-type iron golf club heads (e.g. loft angle and lie angle) tend to result in damage to the club head that impairs structural integrity and performance.

SUMMARY

A need exists for a golf club head that incorporates high-performance materials and structural design without foregoing customizability.

A golf club head according to an example of the invention may include a striking ace having a face center and an imaginary striking face plane, a sole portion, a top portion having an exterior surface, a hosel extending from the top portion, and a loft angle no less than 18°. When the club head is oriented in a reference position, in an imaginary vertical plane laterally spaced from the face center by no more than 10 mm and perpendicular to the imaginary striking face plane, an imaginary line segment having a length of 25 mm, a first endpoint coplanar with the imaginary striking face plane, and a second endpoint located above the exterior surface, forms an angle θ with the imaginary striking face plane between 55° and 65°. The imaginary line segment is tangent to the exterior surface at a first point that is intermediate the first end point and the second end point. A second point is located on the imaginary line segment and spaced from the first point by no less than 1.0 mm. The second point is spaced from the exterior surface by a gap distance, measured perpendicular to the line segment, that is no greater than 0.15 mm.

In another example of the present invention, a golf club head may include a striking face having a face center and an imaginary striking face plane, a sole portion, a top portion having an exterior surface that includes a first surface portion, a second surface portion rearward of the first surface portion, and a third surface portion rearward of the second surface portion, wherein the second surface portion forms a chamfer. The golf club head may also include a hosel extending from the top portion, and a loft angle no less than 18°. In an imaginary vertical plane laterally spaced from the face center by no more than 10 mm and perpendicular to the imaginary striking face plane, the chamfer includes a forwardmost endpoint, a rearwardmost endpoint, and a chamfer length, $l_3$, between the forwardmost endpoint and the rearwardmost endpoint that is no less than 2 mm. An imaginary line segment having a length of 25 mm, a first endpoint coplanar with the Imaginary striking face plane, and a second endpoint located above the exterior surface, forms an angle θ with the imaginary striking face plane that is between 55° and 65°. The imaginary line segment is tangent to the exterior surface at a tangent point that is intermediate the forwardmost endpoint and the rearwardmost endpoint of the chamfer.

In another example of the present invention, a golf club head may include a striking face having a face center and an imaginary striking face plane, a sole portion, a top portion having an exterior surface that includes a first surface portion, a second surface portion rearward of the first surface portion, and a third surface portion rearward of the second surface portion, wherein the second surface portion forms a chamfer. The golf club head may also include a hosel extending from the top portion and a loft angle no less than 18°. In an imaginary vertical plane laterally spaced from the face center by no more than 10 mm and perpendicular to the imaginary striking face plane, the chamfer forms an angle θ, with a plane parallel to the striking face plane, that is between 55° and 65°.

In another example of the present invention, a method of manufacturing a golf club head may include providing characteristics of at least one generally planar contact surface of an existing customization device, and configuring a portion of an exterior surface of the club head to conform to the contact surface of the customization device when the club head is operatively associated with the customization device.

The various exemplary aspects described above may be implemented individually or in various combinations. These and other features and advantages of the golf club head according to the invention in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein:

FIG. 2(*a*) is a cross-sectional view of the golf club head as shown in FIG. 2 through an imaginary plane, according to one or more aspects;

FIG. 2(*b*) is a rear elevation view of the golf club head as shown in FIG. 2, according to one or more aspects;

FIG. 2(*c*) is a rear elevation view of a golf club head in operative association with the customization device of FIG. 2, according to one or more aspects;

FIG. 2(*d*) is a cross-sectional view of the golf club head of FIG. 2(*c*) through an imaginary plane, according to one or more aspects;

FIG. 3(*a*) is a front elevation view of the golf club head of FIG. 3, according to one or more aspects;

FIG. 3(*b*) is a top plan view of the golf club bead of FIG. 3, according to one or more aspects;

FIG. 3(*c*) is a cross-sectional view of the golf club head of FIG. 3 through an imaginary plane, according to one or more aspects;

FIG. 3(*d*) is a partial cross-sectional view of the club head of FIG. 3(*c*), according to one or more aspects;

FIG. 3(*e*) is a partial cross-sectional view of the club bead of FIG. 3(*c*), according to one or more aspects;

FIG. 5(*b*) is a partial cross-sectional view of a golf club head through an imaginary plane, according to one or more aspects;

FIG. 5(*c*) is a partial cross-sectional view of a golf club head through an imaginary plane, according to one or more aspects;

FIG. 5(*d*) is a partial dross-sectional view of a golf club head through an imaginary plane, according to one or more aspects;

FIG. 6(*b*) is a partial cross-sectional view of a golf club head through an imaginary plane, according to one or more aspects.

DETAILED DESCRIPTION

The following examples will be described using one or more definitions, provided below.

Figure 1:
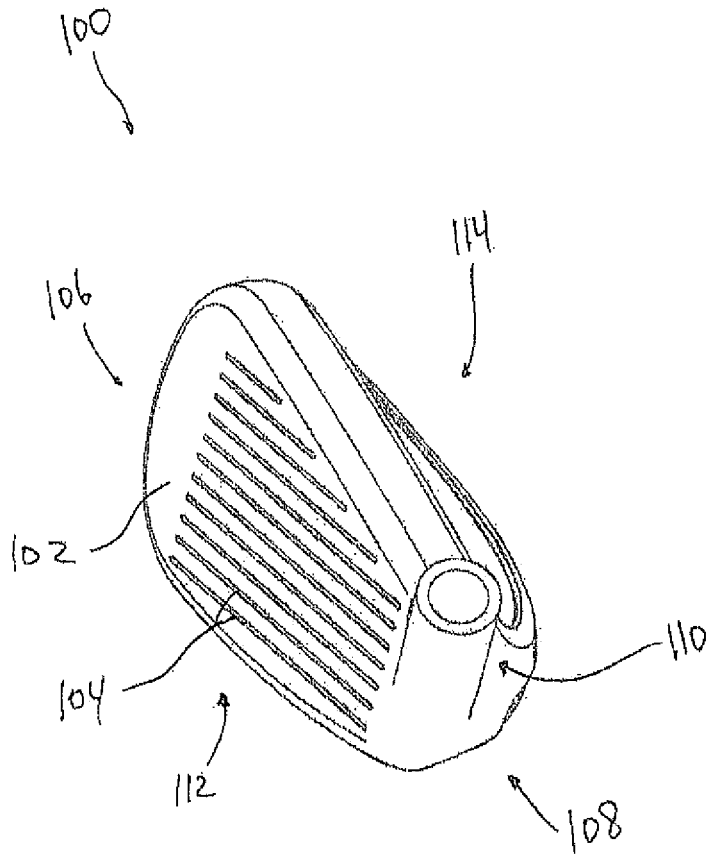
FIG. 1 is a front heel-side perspective view of an exemplary golf club head according to one or more aspects.

Referring to FIG. 1, in one or more aspects, a golf club bead 100 includes a striking face 102, a toe portion 106, a heel portion 108, and a hosel 110 for securing the golf club head 100 to a shaft (not shown). The golf club head 100 further includes a sole portion 112 and a top portion 114 opposite the sole portion 112. The golf club head 100 is preferably an iron-type club head and, thus, has a loft angle no less than 18°.

Figure 1A:
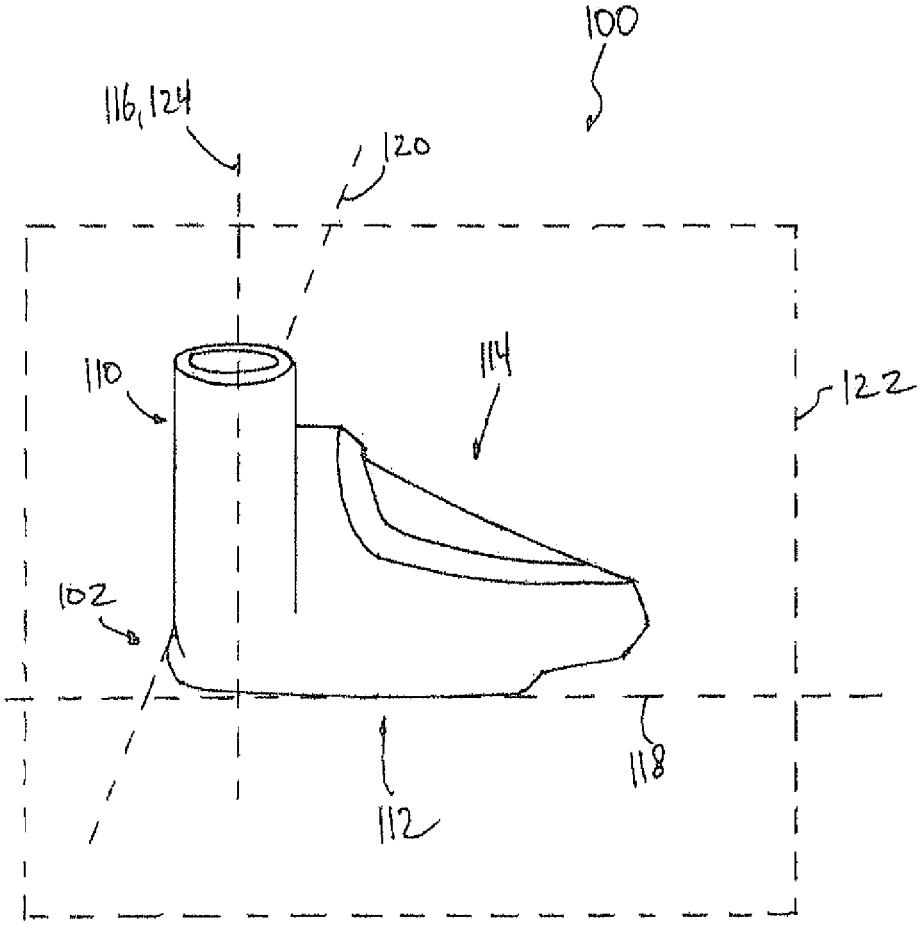
FIG. 1(A) is a heel-side elevation view of the golf club head of FIG. 1, according to one or more aspects.
Figure 1B:
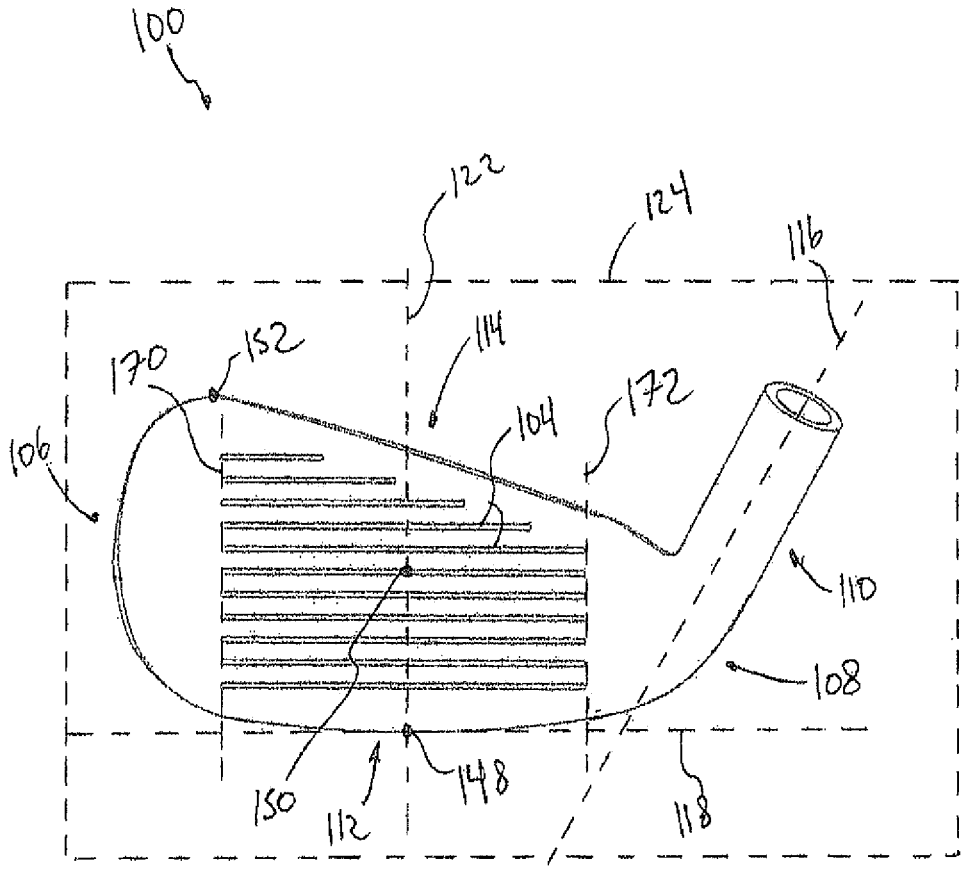
FIG. 1(B) is a front elevation view of the golf club head of FIG. 1, according to one or more aspects.

Referring to FIGS. 1(A) and 1(B), the striking face 102 includes a face center 150, and is substantially coplanar with an imaginary striking face plane 120. For example, in some aspects, the striking face 102 is planar. However, in alternative aspects, the striking face 102 includes a bulge and/or roll of a relatively high radius of curvature, i.e. greater than or equal to 4 in. Alternatively, or in addition, the striking face 102 includes a plurality of scorelines 104 that extend rearwardly from the imaginary striking face plane 120, and/or small-scale recesses or projections that enhance the texture of the striking face 102. For example, in some aspects, at least a portion of the striking face 102 is sandblasted, milled, etched, and/or laser-milled. In aspects in which the striking face 102 includes a bulge and/or roll, for all purposes herein, the imaginary striking face plane 120 is considered to be an imaginary plane tangent to a face center 150 of the striking face, as defined below. As shown in FIG. 1(B), the striking face 102 also includes an uppermost point 152, and a lowermost point 148.

Referring again to FIG. 1(B), the face center 150, as used herein, denotes a point that is laterally spaced halfway between a heelmost end 172 and a toemost end 170 of the plurality of scorelines 104, and vertically, halfway between the uppermost point of the striking face 102 and the lowermost point 148 of the striking face 102. For club heads that are absent any scorelines, the face center 150 denotes the geometric center of the generally planar striking face 102 of the club head 100.

Referring to FIGS. 1(A) and 1(B), the golf club head 100 is oriented in a reference position relative to an imaginary ground plane 118. The hosel 110 include a hosel central axis 116. The striking face 102 is generally coplanar with the imaginary striking face plane 120. A first imaginary vertical plane 122 is perpendicular to the striking face plane 120 and passes through the face center 150. The reference position (of a golf club head), as used herein, denotes a position in which the hosel central axis 116 is coplanar with an imaginary vertical hosel plane 124 that is perpendicular to the first imaginary vertical plane 122, and the scorelines 104 are generally parallel to the ground plane 118.

Figure 1C:
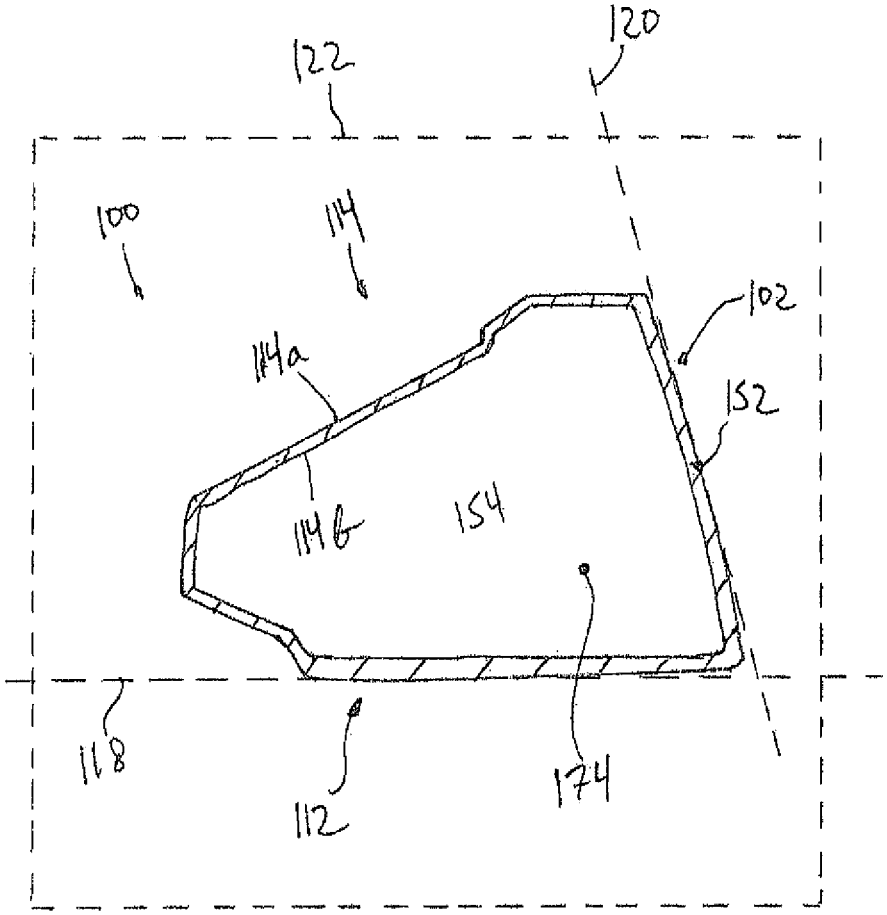
FIG. 1(C) is a cross-sectional view of the golf club head of FIG. 1 through an imaginary plane, according to one or more aspects.

As shown in FIG. 1(C), the golf club head 100 is shown in cross-section through the plane 122. In this cross-section, the top portion 114 includes an exterior surface 114(*a*) and an interior surface 114(*b*). Preferably, the golf club head 100 is a hollow-type golf club head, i.e. includes a hollow 154 delimited by the striking face 102, the top portion 114, and the sole portion 102. In alternative aspects, the golf club head 100 is substantially, but not entirely, hollow. In other aspects, the golf club bead 100 is solidly formed. In some aspects, the hollow 154 is filled with a material different from a material forming the top portion 114, sole portion 112, striking face 102, and/or hosel 110. The material filling the hollow 154 may comprise any of a foam, a polymeric material, a metal, a gel, a visco-elastic material, or any combination thereof. Preferably, the material filling the hollow comprises a density less than that of the material forming at least one of the top portion 114, the sole portion 112, the striking face 102, and/or the hosel portion 110. Preferably, the filling material comprises a specific gravity no greater than 8, more preferably no greater than 7, and most preferable no greater than 5. Such properties enable the golf club head 100 to maintain a high moment of inertia, given a predetermined mass budget, particular about a vertical axis passing through a center of gravity 174 of the club head 100 ($I_{zz}$), as discussed in more detail below.

Preferably, the golf club head 100 is formed of thin-walled construction. In other words, at least one of the sole portion 112, the striking face 102, and/or the top portion 114 have average thicknesses no greater than 10 mm, more preferably no greater than 5 mm, and most preferably no greater than 4 mm. Preferably, in the imaginary plane 122, at least the top portion 114 comprises an average thickness no greater than 10 mm, more preferably no greater than 5 mm, even more preferably within the range of about 1 mm and about 4 mm, and most preferably substantially equal to about 3 mm. Minimizing the average thicknesses of the various portions of the golf club head 100 increases discretionary mass, i.e. mass which may be positioned primarily to enhance the mass properties and, in turn, performance characteristics, of the club head 100. It is particularly desirable to form the top portion 114 of thin-wall construction, as a decreased height of the center of gravity 174 of the club head increases dynamic loft and is generally associated with improved ball flight characteristics. However, decreasing average thickness of the club head components below the ranges discussed above may compromise the structural integrity of the golf club head 100, resulting in damage during use. Of course, acceptable average thickness ranges depend on material selection. Thus, one of ordinary skill in the art would appreciate that, for certain materials, acceptable average thickness ranges may differ from those discussed above. Further, one of ordinary skill in the art would appreciate that, as material properties advance over time, thicknesses below the ranges discussed above may become feasible.

Alternatively, or in addition, the top portion 114 includes a minimum wall thickness no greater than 5 mm, more preferably no greater than 3 mm, even more preferably within the range of 0.40 mm and 1.40 mm, and most preferably substantially equal to about 1.0 mm. These ranges ensure that the top portion 114 is capable of withstanding stresses resulting from typical impacts of the golf club head 100 with a golf ball, while increasing discretionary mass, which may be located elsewhere to further enhance the performance of the golf club head 100.

In some aspects, the golf club head 100 preferably includes a club head volume no less than 50 cc, more preferably no less than 55 cc, even more preferably within the range of about 60 cc to about 180 cc. In some embodiments, a correlated set of club heads includes at least two club heads that vary in volume. For example, in some embodiments, a correlated set includes a #3-iron, having a loft between 17° and 20°, with a volume in the range of about 80 cc to about 110 cc, more preferably within the range of about 90 cc to about 105 cc, and most preferably, equal to about 98 cc. The same correlated set, in some embodiments, also includes a pitching wedge (PW), having a loft angle between 42° and 48°, with a volume in the range of about 45 cc to about 70 cc, more preferably within the range of about 50 cc to about 65 cc, and most preferably equal to about 63 cc. Thus, in some embodiments, the volumes of club heads of a correlated set preferably decrease with increasing loft, for at least two, preferably three, and more preferably each of the, club heads of the set. Of course, in alternative embodiments, volume increases with loft, or, alternatively, does not follow a discernable progression in this regard.

Alternatively, or in addition, the golf club head preferably has a club head mass no greater than 320 g, more preferably no less than 175 g, even more preferably within the range of 200 g to 310 g, and most preferably within the range of about 225 g to about 310 g. These combinations of volume and mass ensure that the club head has a relative high moment of inertia (MOI), particularly about an imaginary vertical axis passing through the center of gravity of the club head ($I_{zz}$), while maintaining the mass of the club head within ranges that achieve beneficial feel and enable the club bead 100 to be appropriately swing weighted.

As discussed above, the golf club 100 includes a hollow construction and, in some embodiments, thin-walled constructions. These attributes enable iron-type golf clubs to achieve higher moments of inertia, particularly about the centers of gravity. For example, the golf club head 100 preferably has a moment of inertia about a vertical axis passing through the center of gravity 174 (e.g. $I_{zz}$) no less than 2000 g*cm$^2$, more preferably no less than 2200 g*cm$^2$, and most preferably no less than 2250 g*cm$^2$. In some embodiments, the moment of inertia, $I_{zz}$, is no greater than 3000 g*cm$^2$, and preferably no greater than 2850 g*cm$^2$. Such parameters enable high forgiveness of the club head on off-centered golf shots.

As discussed above, the golf club head 100 preferably is of hollow, thin-walled construction. Although such construction provides the performance benefits discussed above, such design hinders customizability.

Figure 2:
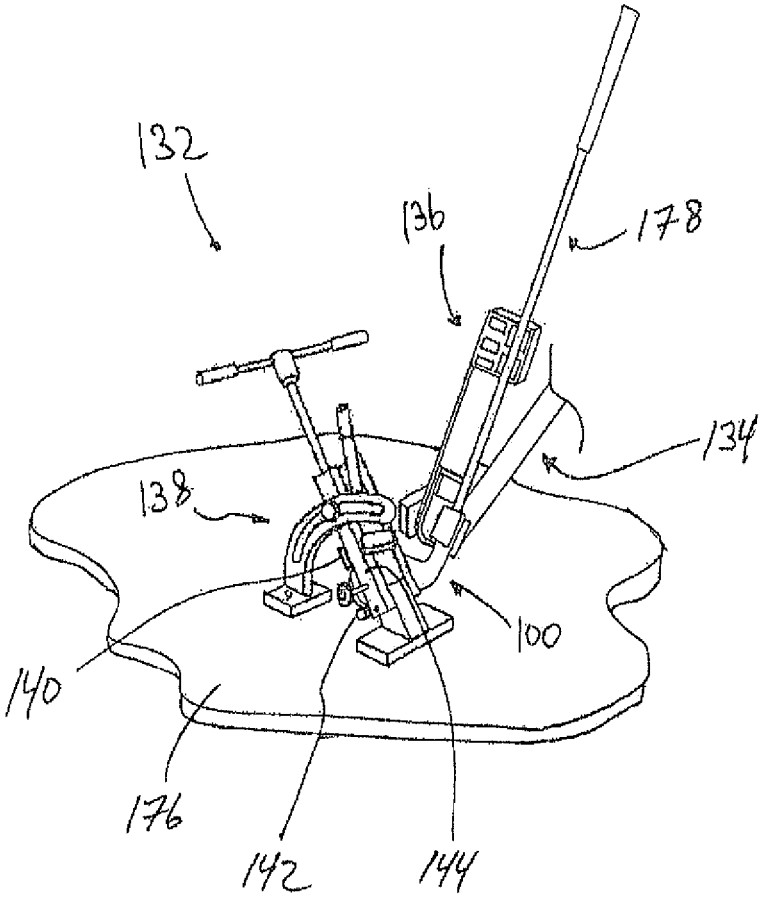
FIG. 2 is a perspective view of the golf club head of FIG. 1 in operative association with a customization device, according to one or more aspects.

With reference to FIG. 2, the golf club head 100 is shown in association with a customization device 132. The customization device 132 includes a base 176, a clamp 138 secured to, and extending upward from, the base 176, and a loft/lie gauge 136. The clamp 138 is adapted to secure the golf club head 100 in a fixed position, preferably in the reference position, so that the loft/lie gauge 136 may statically and/or dynamically measure and indicate the loft angle and/or lie angle of the club head 100, by association with the shaft 178 of the club bead 100.

In operation, a bending bar 134 is associated with hosel 110 of the golf club head 100. Manual force is applied to the bending bar 134 resulting in deformation of the hosel 110. The hosel 110 is relocated to a position in which the golf club 100 has properties (e.g. loft angle and/or lie angle) more favorable to the specific golfer for which the golf club 100 is to be customized.

Generally, some customizing devices are configured for use with iron-type golf clubs (e.g. the STEELCLUB® Angle Machine by Mitchell Golf Equipment Company of Dayton, Ohio) and some are intended specifically for wood-type golf clubs. For example, for customization devices specifically configured for use with iron-type club heads, a clamp is provided that includes a plurality of jaws that are positioned, and have contact surfaces angled, to fit typically-shaped iron-type golf clubs without marring, or with minimally marring, the various surfaces of the clamped iron-type club head. Marring may occur by the engagement of the jaws with the club head either (a) by operation of securing the club head to the clamp; or (b) during the forceful manual operation of the bending bar 134. As hollow-type and/or or thin-walled iron-type golf clubs deviate from the typical shape and structural framework of iron-type club heads, the occurrence and degree of marring is relatively significant, impairing the performance characteristics and structural integrity of the club head 100.

The inventors have discovered that such marring may be prevented by adapting hollow-type iron club heads, through various means, for use with such pre-existing customization devices without appreciably compromising the club heads' performance, structural integrity, and cost of manufacture. These adaptations are described below in farther detail.

The following embodiments are described with reference to the customization device 132, which is similar to a Mitchell STEELCLUB® Angle Machine. However, those of ordinary skill in the art would readily appreciate that like adaptations may be made to club heads for use with other known customization devices, or customization devices that may become known, without departing from the spirit and scope of the invention.

Referring to FIG. 2, the clamp 138 further includes a downwardly-engaging jaw 140 and a plurality of upwardly-engaging jaws 142. In operation, the golf club head 100 is positioned to rest on the upwardly-engaging jaws 142. The downwardly-engaging jaw 140 is moved into contact with the top portion 114 of the club head 100. Specifically, the downwardly-engaging jaw 140 is positioned on the exterior surface 114(*a*) of the top portion 114 as to securely fix the golf club head 100 in position. Thus, the effect of this contact on the exterior surface 114(*a*) is a significant concern. The golf club head 100 is also positioned laterally such that the toe portion 106 of the club head 100 rests against a toe stop 200. The toe stop 200 is preferably adapted to be adjustable in the lateral direction, such that the customization device 132 is capable of fitting a wide array of club heads. Preferably, the toe stop 200 is positioned such that the face center 150 of the club head 100 is horizontally aligned with the center of the downwardly-engaging jaw 140.

In some embodiments, the golf club bead 100 includes one or more design features directed at reducing or eliminating marring caused by the interaction of the top portion 114 with the downwardly engaging jaw 140 of the customization device 132. In general, marring is reduced by: (a) configuring the surface contour of the exterior surface 114(*a*) of the top surface 114 to better accommodate the anticipated contours of the downwardly-engaging jaw 140; and/or (b) selectively strengthening the contact region relative to regions proximate the contact region. These aspects will be discussed in further detail below.

Figure 2A:
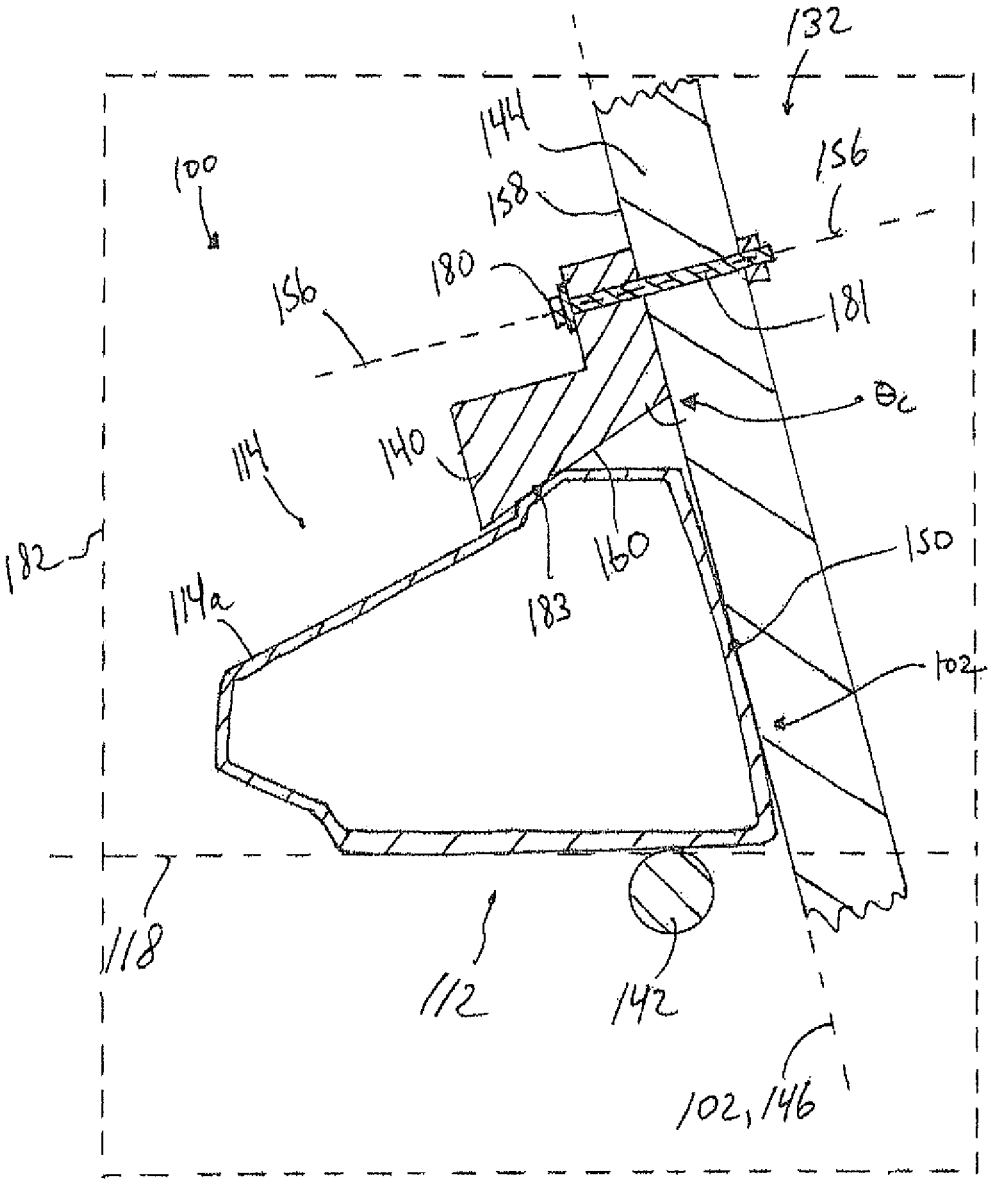
Figure 2:
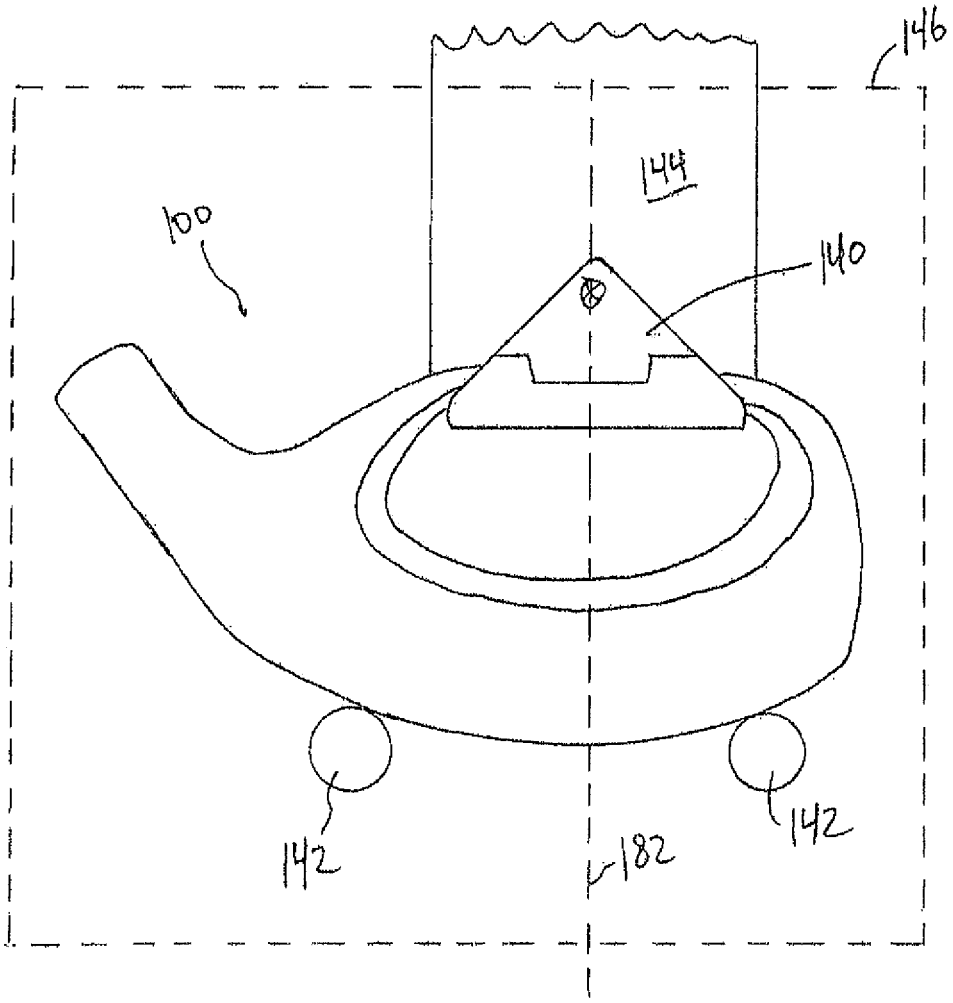
Figure 2C:
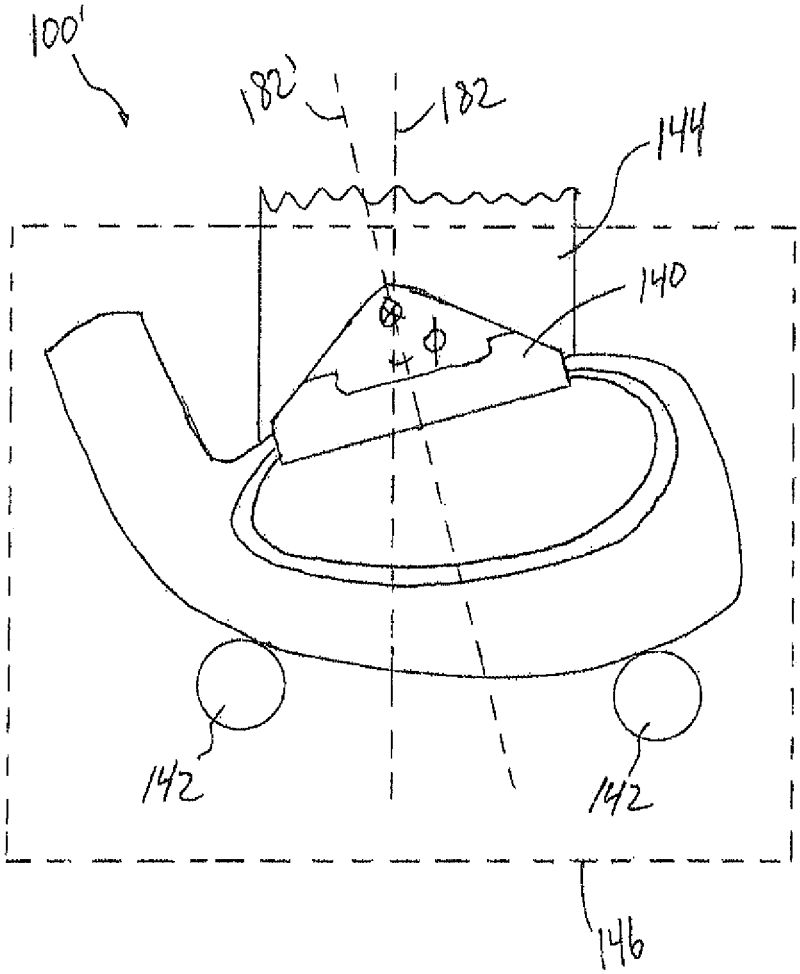
Figure 2D:
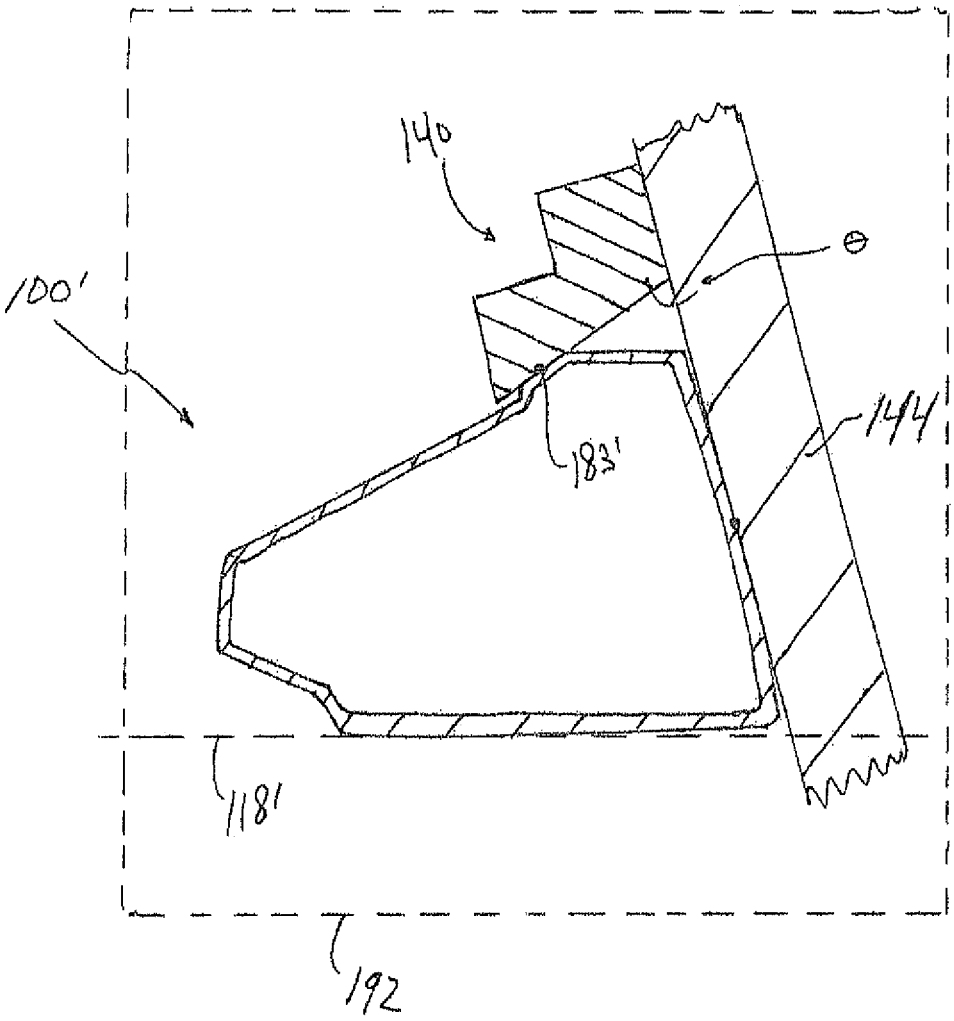

As shown in FIG. 2(*a*), in an operating position, the golf club head 100 is secured to the customization device 132. In this position, the striking face 102 of the club head 100 is flush against the abutment plate 144. The contact surface, or abutment surface 158, of the abutment plate 144 is substantially coplanar with an imaginary abutment plane 146 (see FIG. 2(A)). The sole portion 112 of the club head 100 rests on the upwardly-engaging jaws 142. The downwardly-engaging jaw 140 is lowered into fixed association with the exterior surface 114(*a*) of the top portion 114. The downwardly-engaging jaw 140 includes an abutment surface 158 that lies flush against the abutment plate 144. The downwardly-engaging Jaw 140 also includes a contact surface 160 that contacts the exterior surface 114(*a*) of the top portion 114. A pin 180 extends through a throughbore 181 in the downwardly-engaging jaw 140 enabling the downwardly-engaging jaw 140 to pivot about a pivot axis 156. The pivot axis 156 is perpendicular to the abutment plane 146. The pivotability of the downwardly-engaging jaw 160 enables the downwardly-engaging jaw 140 to accommodate club heads having top portions 114 that are generally inclined or declined toward their respective toe portions 106 in the heel-to-toe direction.

Referring to FIGS. 2(*a*) and 2(*b*), the golf club head 100 is shown in association with the customization device 132 in an operating position. In this position, the downwardly-engaging jaw 140 is in a centered position. A centered position, as used herein, refers to the position in which an imaginary plane 182 perpendicular to the contact surface 160 of the downwardly-engaging jaw 140 and coplanar with the pivot axis 156 is vertical relative to the ground plane 118. Generally, the downwardly-engaging jaw 140 will be in this orientation when associated with a golf club head, e.g. golf club head 100, that comprises a top portion 114 that is neither inclined nor declined in the heel-to-toe direction.

An angle θ, as used herein, denotes the angle formed between the contact surface 160 of the downwardly-engaging jaw 140 and the imaginary abutment plane 146 measured in a vertical plane perpendicular to the abutment plane 146 and passing through the contact point 183. When the downwardly-engaging jaw 140 is in the centered position, in an Imaginary vertical plane passing through a contact point 183 between the contact surface 160 of the downwardly-engaging jaw 140 and the exterior surface 114(*a*) of the top portion 114, the angle θ is equal to $\theta_c$. In some aspects, the customization device 132 is configured such that $\theta_c$ is equal to 60°. However, in other aspects, $\theta_c$ is less than or greater than 60°. The angle $\theta_c$ may be considered an inherent property of the customization device 132.

As shown in FIG. 2(*c*), a golf club head 100' is associated with the customization device 132 in an orientation such that the downwardly-engaging jaw 140 is not in the centered position. Specifically, an imaginary plane 182' is perpendicular to the contact surface and passes through the pivot axis 156. The imaginary plane 182' forms an angle ϕ with the imaginary vertical plane 182 when projected into the abutment plane 146 (i.e. the plane of the paper as shown in FIG. 2(*c*)).

Referring to FIG. 2(*d*), the golf club head 100' is shown in a vertical plane 192 that passes through a contact point 183' between the contact surface 160 of the downwardly-engaging jaw 140 and the exterior surface 114(*a*) of the top portion 114 of the golf club bead 100'. In this case, as compared to the golf club head 100 of FIGS. 2(*a*) and 2(*b*), the downwardly-engaging jaw 140 is rotationally offset by an offset angle ϕ from its centered position. As a result, in the imaginary vertical plane 192, the angle θ also differs from $\theta_c$ (measured when the downwardly-engaging jaw 140 is in the centered position). Thus, the angle θ may be viewed as a function of the angle $\theta_c$ (an inherent property of the customization device) and the offset angle ϕ (a characteristic of the interaction between a customization device and a specific club head). Specifically, angles θ, $\theta_c$, and ϕ are related as follows:

$$\theta(\phi)=\tan^{-1}[\tan(\theta_c)*\cos(\phi)]$$

On the basis of the constraints and intended operation discussed above, various exemplary golf club heads are configured, as discussed below.

EXAMPLE

Anticipating the constraints and operation discussed above, referring to FIGS. 3 through 3(*e*), a golf club head 100, according to one or more aspects, is configured to minimize marring in a first example. In this example, the configuration of the club head 100 is adapted for use with a specific customization device, i.e. the customization device 132 discussed above. Also, the orientation and bounds of the contact surface 160 of the downwardly-engaging jaw 140 is modeled by an imaginary planar surface that forms an imaginary planar line segment in a specified imaginary vertical plane, e.g. an imaginary vertical plane passing through the face center 150 of the club head 100, when the club head 100 is in the reference position. One of ordinary skill in the art would readily appreciate that a club head may be adapted to accommodate other customization devices that are known in the art, or that may become known, in similar manner to this example, or other examples, described herein. In particular, similar adaptations as those described below, but in view of other customization devices having differently-oriented contact surfaces, are within the spirit and scope of the invention.

Figure 3:
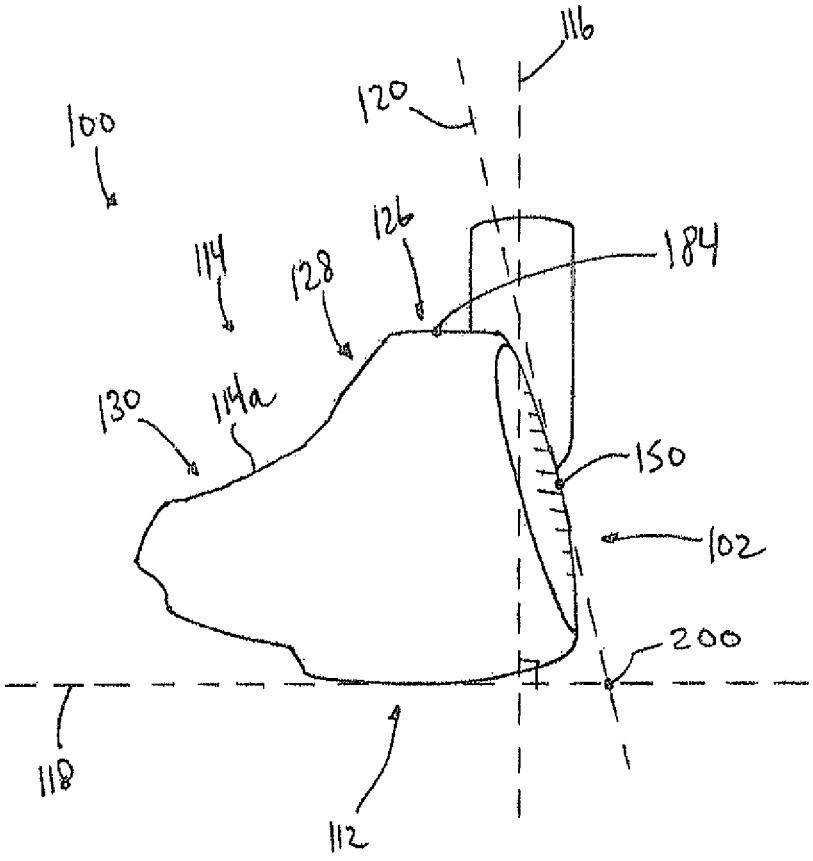
FIG. 3 is a toe-side elevation view of a golf club head, according to one or more aspects.
Figure 3A:
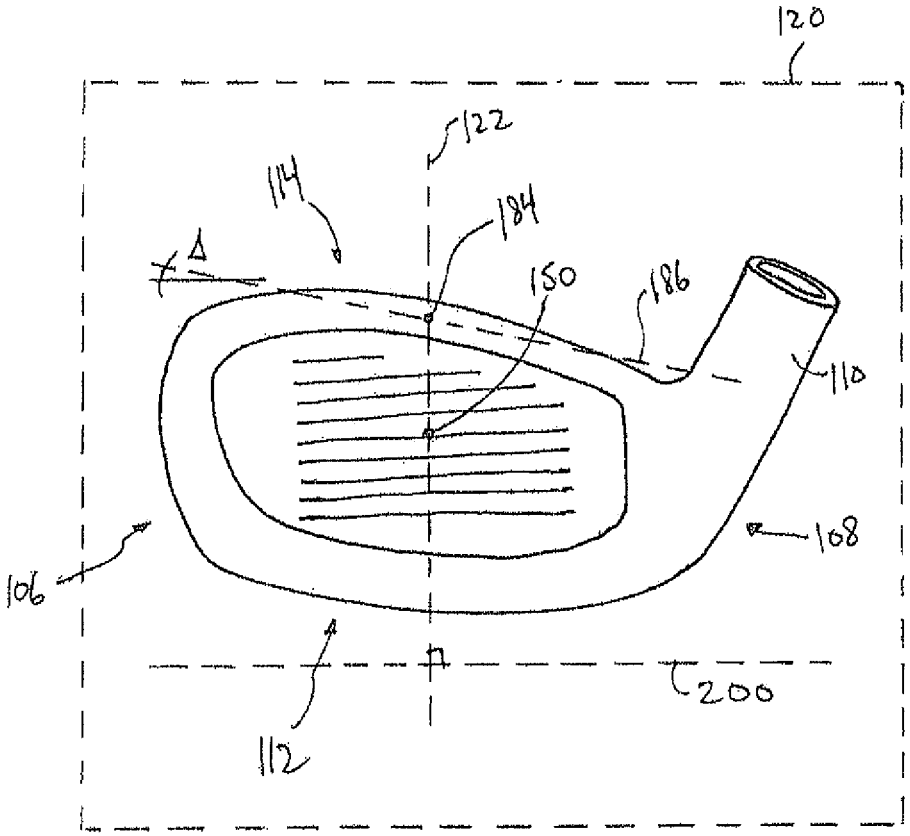
Figure 3F:
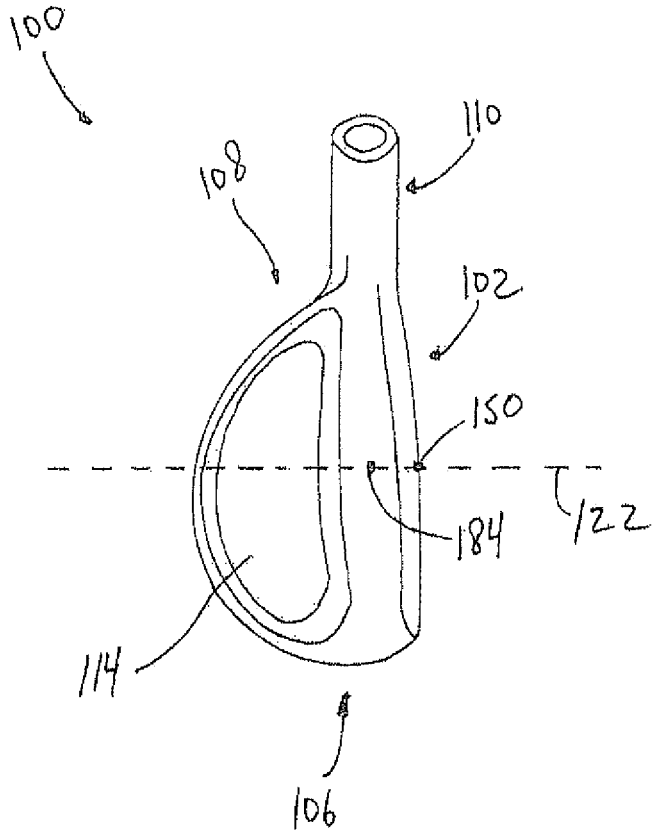
Figure 3C:
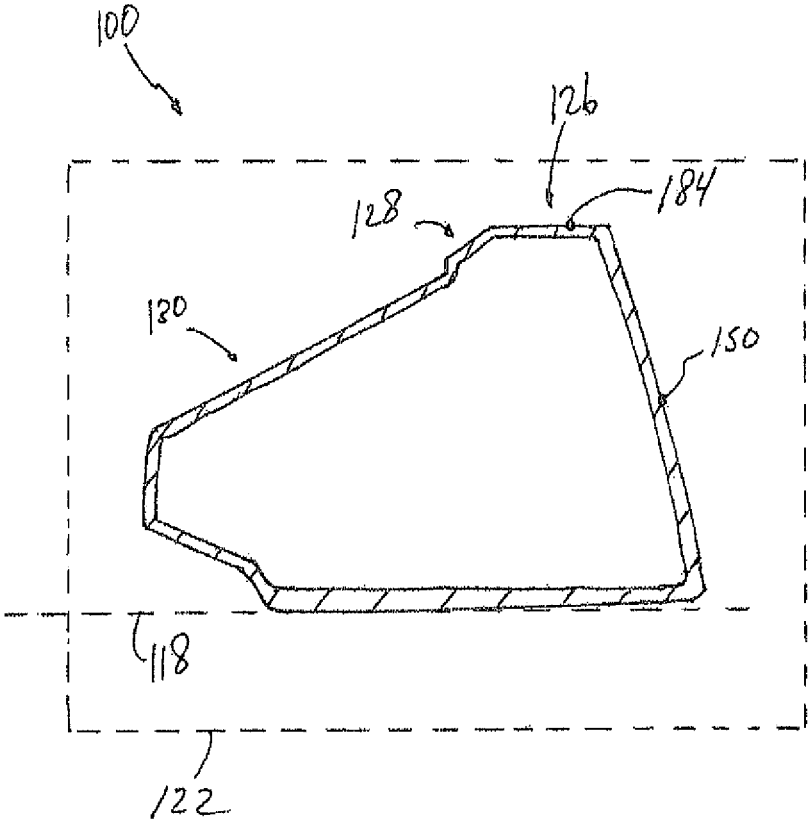
Figure 3D:
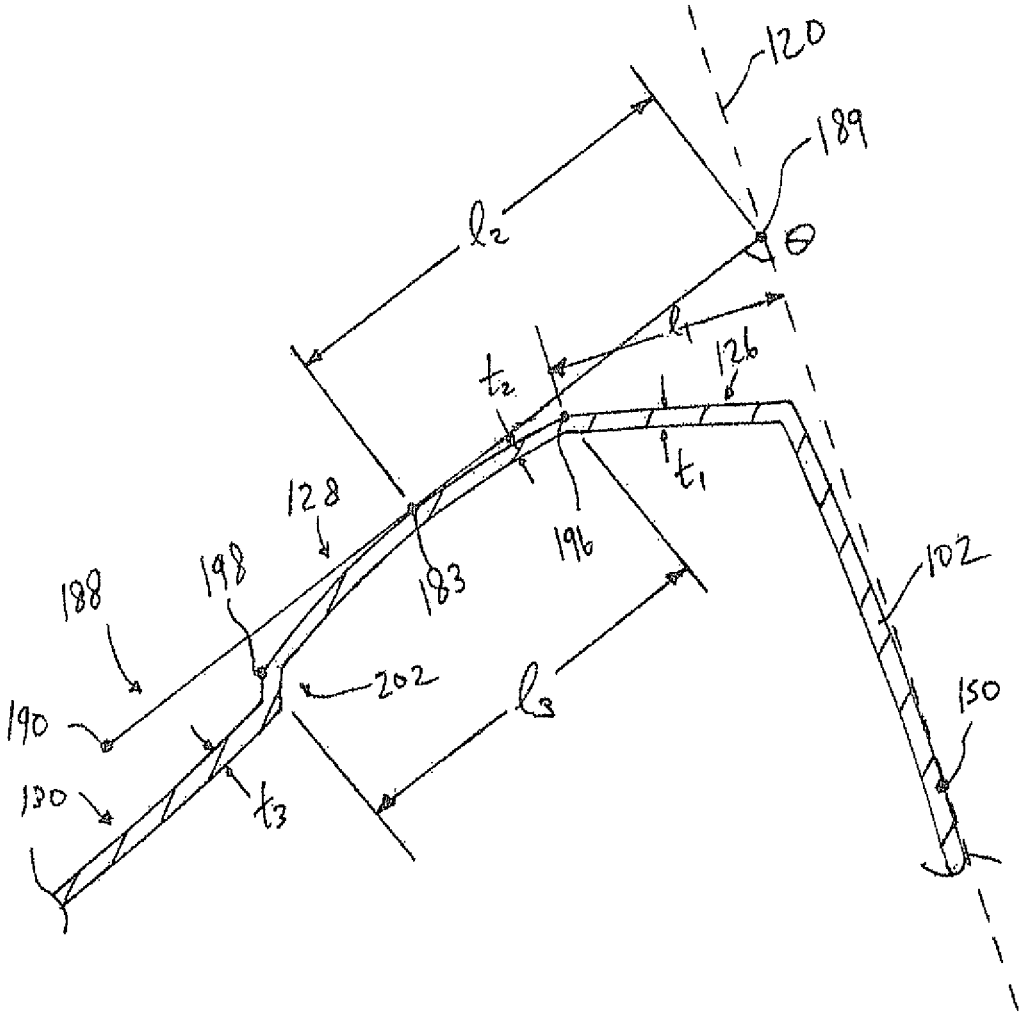
Figure 3E:
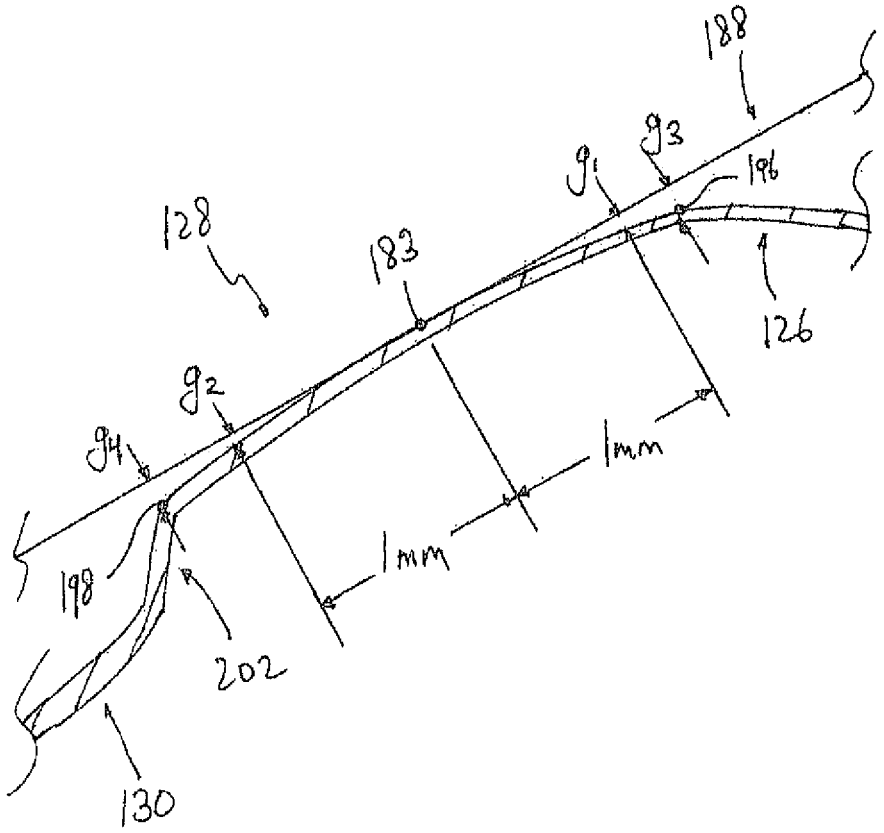

In one or more aspects of the present invention, referring to FIG. 3, the golf club head 100 is shown in the reference position. In FIG. 3(*a*), the golf club head 100 is shown such that the imaginary striking face plane 120 corresponds with the plane of the paper. The exterior surface 114*a* of the top portion 114 of the club head 100 includes a first surface portion 126, a second surface portion 128, and a third surface portion 130. The second surface portion 128 is located between the first surface portion 126 and the third surface portion 130 and, in some aspects, defines a chamfer sandwiched between the first surface portion 126 and the third surface portion 130, as shown. The striking face 102 of the club head 100 includes the face center 150 and is generally coplanar with the imaginary striking face plane 120.

As shown in FIGS. 3 through 3(*b*), the imaginary vertical plane 122 passes through the face center 150. Specific to the imaginary plane 122, an uppermost point 184 is located on the top portion 114 of the club head 100 (when the club head is in the reference position, as in FIG. 3). An imaginary tangent line 186 is parallel to the imaginary striking face plane 120 and lies tangent to the uppermost point 184 such that the tangent line 186 does not pass through the exterior surface 114(*a*) of the top portion 114 of the club head 100 (i.e. excluding the hosel 110). The ground plane 118 intersects the imaginary striking face plane 120 to form an imaginary line 200. The imaginary tangent line 186 forms an angle Δ with the horizontal, measure in the plane 120. In practical terms, the angle Δ corresponds to the anticipated angle ϕ, as discussed above.

Referring to FIGS. 3(*c*) and 3(*d*), the golf club head 100 is shown in cross-section through the imaginary plane 122. As shown in FIG. 3(*d*), in the imaginary plane 122, an imaginary line segment 188 is shown. The Imaginary line segment 188 lies tangent to the exterior surface 114(*a*) at a contact point 183 and does not pass through any portion of the exterior surface 114(*a*) of the top portion 114. In this example, the imaginary line segment 188 has a length of 25 mm, a first endpoint 189 coincident with the imaginary striking face plane 120, and a second endpoint 190 opposite the first end point 189. The second endpoint 190 is located above the exterior surface 114(*a*) of the top portion 114. In practical terms, the imaginary line segment 188 serves to model the extent and orientation of the contact surface 160 of the downwardly-engaging jaw 140, when the club head 100 is associated with the customization device 132 in an operating position. Accordingly, the imaginary line segment 188 further forms the angle θ with the imaginary striking face plane 120. Because the angle Δ is intended to correspond to the angle ϕ discussed above, θ may alternatively be represented as a function of Δ as follows:

$$\theta(\Delta)=\tan^{-1}[\tan(\theta_c)*\cos(\Delta)]$$

In this example, based on the intended customization device 132 with which the club head 100 is to be associated with, $\theta_c$ is assumed to be 60°. Referring again to FIG. 3(*a*), the top portion 114 of the golf club head 100 generally inclines from the heel portion 108 toward the toe portion 106. Thus, when the golf club head 100 is associated with the customization device 132 in an operating position, the downwardly-engaging jaw 140 would pivot about the pivot axis 156 from its centered position. As a result, in the vertical cross-section 122, the angle θ between the line segment 188 and the striking face plane 120 varies slightly from $\theta_c$ (or from 60°). In this example, the angle Δ is 1°, and, thus the angle θ is still about 60°. Referring again to FIG. 3(*d*), preferably, the club head 100 is configured such that the second endpoint 190 of the imaginary line segment 188 is located above the exterior surface 144(*a*) of the top portion 114. This ensures that the region of potential contact between the downwardly-engaging jaw 140 and the exterior surface 114(*a*) is sufficiently large to reduce average stress below a point at which marring, or plastic deformation, is likely to occur. This also prevents the occurrence of high stress due to a corner of the downwardly-engaging jaw 140 compressing the exterior surface 114(*a*) of the top portion 114 of the club head 100.

Referring again to FIG. 3(*d*), the second surface portion 128 defines a chamfer and is located between the first surface portion 126 and the third surface portion 130. In some embodiments, and as shown, a stepped portion 202 is further located at the junction between the second surface portion 128 and the third surface portion 130. In some embodiments, the second surface portion 128 is also stepped up from the first surface portion 126. In alternative embodiments, the second surface portion 128 is directly joined to the third, generally planar, surface portion 130.

The second surface portion 128 includes a first, forwardmost, endpoint 196, and a second, rearwardmost, endpoint 198. The distance $l_3$ between the first and second endpoints 196 and 198 is preferably within the range of 2 mm and 6 mm. More preferably, the distance $l_3$ is between 2.5 mm and 4 mm and, most preferably, substantially equal to about 3.4 mm. These ranges ensure that, when in operative association with the customization device 132, the corners of the downwardly-engaging jaw 140 remain distanced from, and thereby do not compress, the exterior surface 114*a* of the top portion 114 of the club head. If the distance $l_3$ is too large, the second surface portion 128, i.e. the chamfer, detracts from the structural and aesthetic aspects of the top portion 114 of the club head 100, affecting the acoustic and other vibration-emanation properties of the club head 100, requiring further remedy.

Preferably the contact point 183 is located generally half-way between the endpoint 196 and the point 198. More specifically, the contact point is located a distance from the endpoint 196 that is between $0.35*l_3$ and $0.65*l_3$, more preferably between $0.40*l_3$ and $0.60*l_3$, and most preferably between $0.45*l_3$ and $0.55*l_3$. These distances are to be measured along the surface of the second surface portion 128 in the imaginary plane 122. These ranges ensure that any force applied to the exterior surface 114*a* of the top portion 114 of the club head 100 by the downwardly-engaging jaw 140 is more evenly distributed over the second surface portion 128 and not primarily directed at either of endpoints 196 and 198.

In the reference position, and in the imaginary plane 122 shown in FIG. 3(*c*), the second surface portion 128 preferably generally extends at an angle formed with the striking face plane 120 that is within 5 degrees of the angle θ. More preferably, the second surface portion 128 is configured to generally extend at an angle with the striking face that is within 2 degrees of θ. Most preferably, the second surface portion 128 generally extends at an angle with the striking face plane 120 that is substantially equal to the angle θ. In this example, the angle θ is substantially equal to 60°, as discussed above. These ranges ensure that, when the club head 100 is operatively associated with the customization device 132, any force asserted by the downwardly-engaging jaw 140 is dispersed over a wider area, and such force is generally centered about the intended contact point 183.

Preferably, the second surface portion 128 (i.e. the chamfer) follows a curvilinear path in the imaginary plane 122. However, in alternative embodiments, the second surface portion 128 follows a generally linear path in the imaginary plane 122. Where the second surface portion 128 follows a curvilinear path, the radius of curvature is relatively large, i.e. greater than about 5 inches. However, in alternative embodiments, the second surface portion 128 follows a curvilinear path having a radius of curvature that is less than 5 inches. Also, alternatively or in addition, the radius of curvature of the path formed by the second surface portion 128 varies in radius of curvature along its length. Preferably, the second surface portion 128 follows a curvilinear path having an average radius of curvature in the range of between about 5 in and 15 in, more preferably within the range of 8 in to about 12 in, and most preferably substantially equal to 10 in.

For embodiments in which the second surface portion 128 follows a curvilinear path, in the imaginary plane 122 shown in FIGS. 3(*c*) and 3(*d*), the general angle of its extension relative to the striking face plane 120 is considered to correspond to the angle formed between the striking face plane 120 and an imaginary line that passes through the first endpoint 196 and the second endpoint 198 of the second surface portion 128 and that intersects with the striking face plane 120.

In addition to the above parameters, the forwardmost endpoint 196 of the second surface portion 128 is preferably spaced from the striking face plane 120 by a minimum distance $l_1$. Preferably, $l_1$ is between about 6 mm and about 20 mm. More preferably, the distance $l_1$ is between 8 mm and 15 mm, and most preferably between 9 mm and 12 mm. A distance, along the imaginary line segment 188, between the first endpoint 189 and the contact point 183 is within the range of about 10 mm to about 22 mm, more preferably between about 12 mm and about 18 mm, and most preferably within the range of 16 mm to 18 mm. These ranges ensure that the point of contact 183 is sufficiently distanced from the striking face 102 to avoid an overly stiff response to the compression created by contact of the downwardly-engaging jaw 140 with the exterior surface 114*a* of the top portion 114. Also, such ranges minimizes the risk that marring may occur proximate the striking face 102, which marring could have an increased effect on structural performance and/or feel associated with impact between the club head 100 and a golf ball. On the other hand, spacing the forwardmost endpoint 196 of the second surface portion 128 of the exterior surface 114*a* of the top portion 114 tends to reduce the effectiveness of the "grip" associated with the contact between the downwardly-engaging jaw 140 of the customization device 132 and the club head 100.

Further, the contact point 183 between the imaginary line segment 188 and the second surface portion 128 lies between the first endpoint 196 and the second endpoint 198. Preferably, the contact point 183 is generally centered between the first endpoint 196 and the second endpoint 198. Alternatively, or in addition, the contact point 183 is spaced from the first endpoint 196 by a distance no less than 0.50 mm and, more preferably, no less than 1.0 mm.

As discussed above, it is desired to configure the second surface portion 128 to follow a curvilinear path, for example in the imaginary plane 122 shown in FIGS. 3(*c*) and 3(*d*). While such a configuration prevents stress concentrations from forming at various contours, e.g. at either endpoint 196 and 198 of the second surface portion 128, it is still desirable to configure the second surface portion 128 to generally conform to the contour of the imaginary line segment 188. As a result, when the club head 100 is operatively associated with the downwardly-engaging jaw 140 of the customization device 132, as force is exerted from the contact surface 160 of the downwardly-engaging jaw 140, the surface-conforming second surface portion 128 flexes in a manner as to increase the area of contact between the contact surface 160 of the downwardly-engaging jaw 140 and the exterior surface 114*a* of the top portion 114 of the club head 100.

Thus, referring to FIG. 3(*e*), a first gap distance $g_1$, measured at a location spaced from the contact point 183 by 1 mm (along the length of the imaginary line segment 188), between the imaginary line segment 188 and the exterior surface 114*a* of the top portion 114 of the club head 100, is preferably no greater than 0.15 mm, more preferably no greater than 0.12 mm, and most preferably within the range of 0.05 mm to 0.11 mm. A second gap distance, $g_2$, is preferably configured in like manner to the first gap distance $g_1$. Alternatively, or in addition, a third gap distance, $g_3$, measured at the first endpoint 196 of the second surface portion 128 of the exterior surface 114*a* is preferably configured in like manner to the gap distance $g_1$. Alternatively, or in additional, a fourth gap distance, $g_4$, measured at the second endpoint 198 of the second surface portion 128, is configured in like manner to the gap distance $g_1$.

As discussed above, referring again to FIG. 3(*d*), the configuration of the second surface portion (i.e. the chamfer) 128 is directed to enabling customization of the club head 100 by typical customization devices, e.g. customization device 132, without the need to unnecessarily thicken these portions of the club head 100. Such thickening would likely diminish the performance of the club head 100 by locating greater mass at higher locations, and requiring more mass to be dedicated to providing for the structural integrity of the club head 100 and, thus, not positioned primarily to affect the mass properties of the club head 100. Thus, an average thickness, $t_2$, of the second surface portion 128 is preferably within the range of about 1 mm to about 4 mm, more preferably between about 1.25 mm and about 3.5 mm, and most preferably between about 1.5 mm and about 3 mm.

Further, in some embodiments, the average thickness $t_2$ of the second surface portion 128 varies with loft angle throughout a correlated set of club heads. For example, for a typical #3-iron, having a loft of about 17°, the average thickness $t_2$ of the second surface portion 128 is within the range of 2 mm and 4 mm. Meanwhile, for a pitching wedge, within the same correlated set, having a loft angle of about 54°, the average thickness $t_2$ of the second surface portion 128 is within the range of about 1 mm to about 2 mm. Additionally, or alternatively, $t_2$ decreases with increasing loft angle for at least two golf club heads of a correlated set of golf club heads. More preferably, $t_2$ decreases with increasing loft angle for at least three golf club heads of a correlated set of golf club heads. Most preferably, $t_2$ decreases progressively with increasing loft angle for each golf club head within a correlated set of golf club heads.

In addition to an average thickness, $t_2$, the second surface portion 128 includes a minimum thickness. Preferably, the minimum thickness is no greater than 2 mm, more preferably, no greater than 1.5 mm, and most preferably, no greater than 1.20 mm.

An average thickness $t_3$ of the third surface portion 130 of the exterior surface 114*a* of the top portion 114 is preferably within the ranges discussed above with regard to the second surface portion 128. Further, an average thickness $t_1$ of the first surface portion 126 of the exterior surface 114*a* of the top portion 114 is preferably within the ranges discussed above with regards to the second surface portion 128.

As discussed above, one or more of the characteristics of the exterior surface 114*a* of the top portion 114 occurs in a vertical cross-section 122 that passes through the face center 150 of the club head 100. Preferably, like exterior surface characteristics occur at other vertical cross-sections that are laterally (i.e. in the heel to toe direction) spaced from the face center 150 of the club head 100. Preferably, like dimensions are found in one or more vertical cross-sections that are laterally spaced from the face center 150 by 10 mm or less, and, more preferably, by 5 mm or less.

Figure 4:
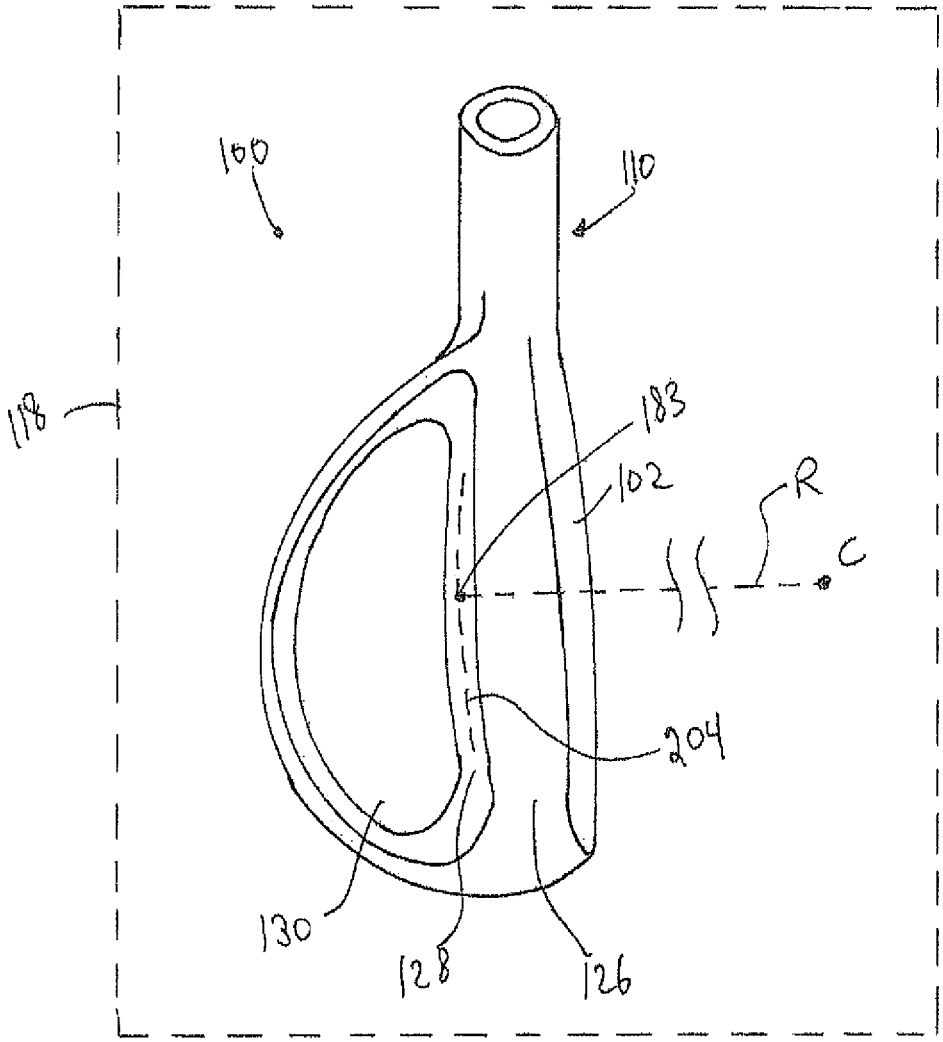
FIG. 4 is a top plan view of a golf club head, according to one or more aspects.
Figure 5A:
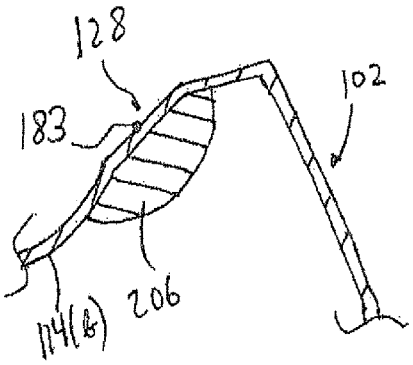
FIG. 5(*a*) is a partial cross-sectional view of a golf club head through an imaginary plane, according to one or more aspects.
Figure 5B:
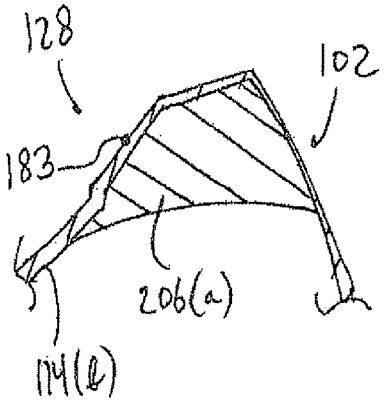
Figure 5C:
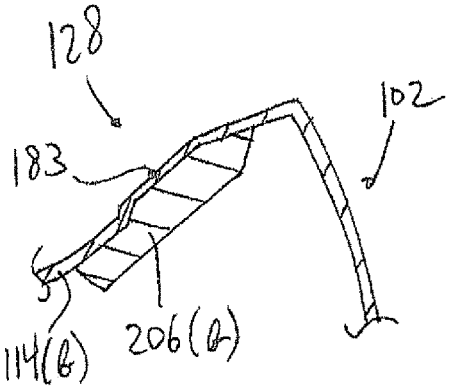
Figure 5D:
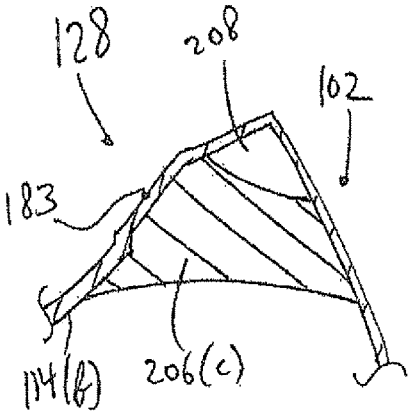

In addition to adapting the club head 100 for customization with a customization device, e.g. customization device 132, in the front to rear direction, a discussed above, in some embodiments, adaptations are implemented in the heel to toe direction. For example, referring to FIG. 4, in some embodiments, proximate the contact point 183, in the heel to toe direction, the exterior surface 114*a* of the top portion 114 of the club head 100 follows a curvilinear path such that the contact point 183 coincides with a bulge point.

For example, referring again to FIG. 4, in some embodiments, proximate the contact point 183, and between the imaginary line segment 188 and the second surface portion 128, the exterior surface 114*a* of the top portion 114 follows a curvilinear path 204 in the lateral direction. Specifically, when viewed in top plan view, as shown, the contour of the second surface portion 128 is convex toward the rear, or rearwardly convex. The path of this portion 128 proximate the contact point 183, in an imaginary horizontal plane, may be considered to have a radius of curvature R and a center point C that is located forward of the striking face 102 of the club head 100. In some embodiments, the radius of curvature R is no less than 5 in, more preferably no less than 8 in, and most preferably between about 8 in and about 25 in. These ranges ensure that, when the club head is operatively associated with the customization device 132, during use, corners of the downwardly-engaging jaw 140 do not contact any portion of the exterior surface 114*a* in the lateral direction (in addition to the front-to-rear direction as discussed above).

In addition to adapting the exterior surface 114*a* of the top portion 114 of the club head 100 to more effectively accommodate a customization device, e.g. customization device 132, the region proximate the contact point 183 of the exterior surface 114*a*, in some embodiments, is strengthened.

Referring to FIGS. 5(*a*) through 5(*d*), a portion of the club head 100 is shown in cross-section through the imaginary plane 122. In these embodiments, a rib (e.g. rib 206, 206(*a*), 206(*b*), or 206(*c*)) is secured to an interior surface 114*b* of the top portion 114 of the club head 100.

For example, in the embodiment shown in FIG. 5(*a*), a rib 206 is associated with the region proximate the contact point 183. In this embodiment, the rib 206 increases in thickness as the rib approaches the contact point 183, in the front to rear direction. In this embodiment, the rib 206 does not contact the interior surface 114*a* proximate the striking face 102.

In the embodiment shown in FIG. 5(*b*), a rib 206(*a*) is secured to the interior surface 114*a* proximate the contact point 183. In this embodiment, the rib 206(*a*) is also joined to the interior surface 114*a* proximate the striking face 102.

In the embodiment shown in FIG. 5(*c*), a rib 206(*b*) is secured to the Interior surface 114*a* proximate the contact point 183. In this embodiment, the rib 206(*b*) includes a substantially uniform thickness along its front to rear length. However, the rib 206(*b*) is not joined to the striking face 102.

In the embodiment shown in FIG. 5(*d*), the rib 206(*c*) is secured to the interior surface 114*a* proximate the contact point 183. In this embodiment, the rib 206(*c*) is joined to the interior surface 114*a* proximate the striking face 102. In this embodiment, an aperture 208 is formed by the rib 206(*c*) and interior surface 114*a* combination. As shown, the aperture 208 extends entirely through the rib 206(*c*). However, in other embodiments, any of the ribs shown in FIGS. 5(*a*) through 5(*d*) may include apertures, recesses, grooves, or fluted portions that extend entirely through, or only partially through the thickness of the rib. Alternatively, or in addition, any of the ribs shown in FIGS. 5(*a*) through 5(*d*), may include projections, struts, or rails extending therefrom.

In addition, or alternatively, to any of the embodiments discussed above, plural ribs are secured to the interior surface 114*a* proximate the contact point 183. Alternatively, or in addition, one or more ribs are secured to the interior surface 114*a* of the club head 100 proximate other regions of the top portion 114, and/or other regions of the club head 100, includes any combination of the sole portion 112, the striking face 102, the heel portion 108, and the toe portion 106.

Alternatively, or in addition, ribs may be secured to the interior surface 114*a* proximate the contact point 183, but not passing through the imaginary plane 122. For example, in some embodiments, a first and second rib are elongated in the front to rear direction, and straddle an imaginary vertical plane 122 perpendicular to the striking fce plane 120 and passing through the contact point 183.

Alternatively, or in addition, one or more ribs are secured to the interior surface 114*a* of the top portion 114 of the club head 100 that are generally elongated in the heel to toe direction, as opposed to the front to rear direction.

Figure 6A:
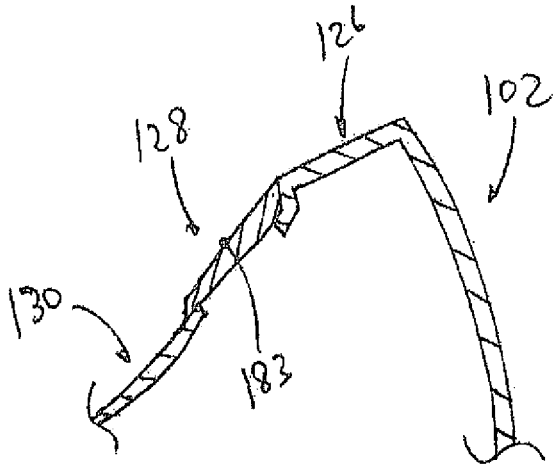
FIG. 6(*a*) is a partial cross-sectional view of a golf club bead through an imaginary plane, according to one or more aspects.
Figure 6B:
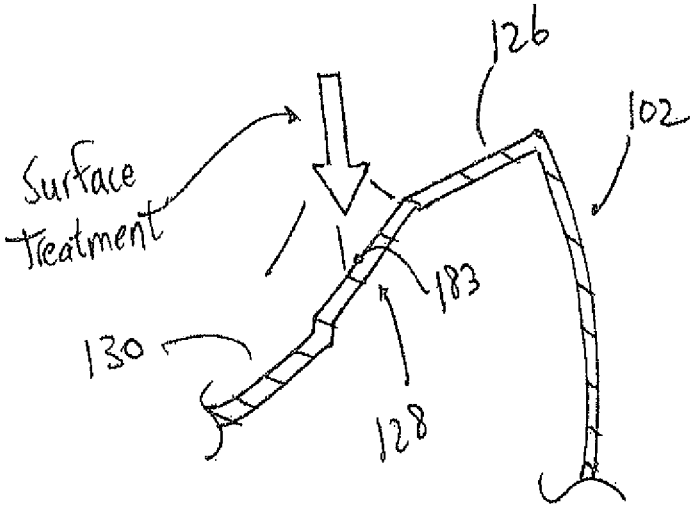

Referring to FIG. 6(*a*), in one or more embodiments, the second surface portion 128 of the exterior surface 114*a* of the top portion 114 includes a first material that is different from a second material of at least one of the first surface portion 126 or the third surface portion 130. In some embodiments, the first material includes a hardness that is greater than a hardness of the second material. Alternatively, the first material includes a stiffness, EI, or Young's modulus, that is greater than either the stiffness, EI, or Young's Modulus of the second material. In some embodiments, the first material has a ductility (e.g. percent elongation) that is greater than the ductility (e.g. percent elongation) of the second material. These characteristics ensure that regions of the top portion 114 anticipated to undergo high strain during operative association with the customization device 132, are particularly suited for such strain. By limiting the use of higher-strength materials to such locations, discretionary mass may be preserved for placement better suited to affect the mass properties (and in turn the performance) of the club head 100.

In some embodiments, the first material has a greater resilience than the second material. For example, in some embodiments, a polymer (e.g. polyurethane or nylons) is particularly located at the second surface portion, while at least one of the first and third surface portions 126 and 130 comprise a stainless steel, such as 17-4 stainless steel, or a titanium alloy, e.g. Ti 8-2 or TI 640. By increasing the resilience of the second surface portion 128, such region is more capable of conforming, in operative engagement with the customization device 132, to the contours of the contact surface 160 of the downwardly-engaging jaw 140. Thus, permanent deformation to the club head 100 may be prevented or minimized.

Referring again to FIG. 6(*a*), the second surface portion 128, in some embodiments, at least in part constitutes a discrete insert that is secured to the remainder of the club head 100 during construction. In some such embodiments, the second surface portion is welded to the remainder of the top portion 114, chemically adhered, bonded, brazed, or attached by a mechanical coupling (e.g. press-fitted, expansion fitted, or the like)

Referring to FIG. 6(*b*), in some embodiments, the second surface portion 128 is formed integrally with the remainder of the top portion 114 of the club head 100. However, the second surface portion 128 is then locally surface treated to gain higher-strength properties. For example, the second surface portion 128 may be locally forged, cold-worked, beat-treated, carbided, nitrided, electroplated, anodized, or otherwise coated, e.g. by a physical vapor deposition process, sputtering or the like, to achieve greater durability and/or resistance to marring. In some embodiments, the surface treatment occurs locally, proximate the contact point 183. However, in other embodiments, the surface treatment occurs over substantially the entirety of the top portion 114. In yet other embodiments, the entire club head 100 undergoes one or more surface treatment processes.

In any of the embodiments discussed above, the golf club head 100 constitutes a club head of a correlated set of club heads. For example, in some embodiments, the club head 100 is an iron-type club head of a correlated at of like iron-type club heads. Preferably, plural club heads of a correlated set, varying in loft angle, include one or morn of the adaptations discussed above, with reference to the club head 100, as golfers often desire to customize characteristics of plural club beads of their set. However, operative engagement of the customization device 132 effects club heads differently, at least in part dependent on their respective loft angles.

For example, in some embodiments, due to natural changes in the structure of club heads throughout a correlated set, the effect of operative engagement with a customization device, e.g. customization device 132, tends to be less severe with increasing loft angle. Thus, in some embodiments, a correlated set includes at least a first club head 100 including a top portion 114 with a second surface portion 128 constituting a chamfer in the manner discussed in any of the embodiments discussed above, while at least a second club bead 100' of the set, with a greater loft angle than the first club head, does not.

In some embodiments, the degree to which the top portion 114 is specifically adapted to withstand impact with the contact surface 160 of the downwardly-engaging jaw 140 varies through the set. For example, lower-lofted club heads may have internal ribs (e.g. as shown in any of FIGS. 5(*a*) through 5(*d*). Alternatively, or in addition, a correlated set includes a first club head 100 having a first loft angle and a first internal nib 206 proximate a first contact point 183 that has a first average thickness $t_1$ and a second club head 100' of the correlated set having a second loft angle greater than the first loft angle, and a second internal rib 206' proximate a second contact point 183' that has a second average thickness $t_2$ less than the first average thickness $t_1$. Alternatively, or in addition a correlated set includes at least a first club head 100 having a first loft angle, a surface portion 128 that forms a chamfer, has an angle θ, and a length $l_3$, and a second club head 100' having a second loft angle greater than the first loft angle, a surface portion 128' that forms a chamfer, has a angle θ, and a length $l_3'$ that is less than the $l_3$ of the first club head 100.

Alternatively, or in addition, a correlated set includes at least a first club head 100 having a first angle $\Delta_1$, a first angle $\theta_1$, and a first loft angle, and a second club head having a second angle $\Delta_2$ greater than $\Delta_1$ and a second loft angle greater than the first loft angle. Because $\Delta_2$ is greater than $\Delta_1$, preferably, the second club head 100' also has a second surface portion 128, forming a chamfer, configured to have an angle $\theta_2$ with the imaginary striking face plane that varies from a first angle $\theta_1$ of the first club head 100. In some such embodiments, variation of θ through a correlated set of club heads varies for at least two club heads of the set in accordance with the following relationship (where $\theta_c$ is equal to 60°):

$$\tan^{-1}[\tan(\theta_c)*\cos(\Delta)]-2.5°\leq\theta(\Delta)\leq\tan^{-1}[\tan(\theta_c)*\cos(\Delta)]+2.5°$$

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

We claim:

1. A method of manufacturing a golf club head, comprising:

referencing a location of a planar contact surface of a golf club customization device relative to the golf club head when the golf club head is oriented in a reference position relative to an imaginary ground plane and when the golf club head is fitted into the golf club customization device, the planar contact surface being a surface of the golf club customization device that contacts an upward-facing outer surface of the golf club head when the golf club head is fitted into the golf club customization device;

based on the referenced location, determining a location of an area of intended contact on the golf club head, the area of intended contact being an area of the upward-facing outer surface of the golf club head that physically contacts the planar contact surface when the club is fitted into the golf club customization device;

configuring a shape of the upward-facing outer surface of the golf club head in the area of intended contact so that the shape of the outer surface conforms to the shape of the planar contact surface;

providing the configured shape of the upward-facing outer surface in the determined area of intended contact; and strengthening the area of intended contact against deformation by providing an internal rib that is located inside the golf club head and contacts an internal surface of the golf club head at a location corresponding to the area of intended contact.

2. The method of claim 1, wherein the location of the area of intended contact is on a top portion of the golf club head.

3. The method of claim 2, wherein the location of the area of intended contact is on a chamfered surface of the top portion of the golf club head.

4. The method of claim 2, wherein, proximate the location of the area of intended contact, the top portion comprises a minimum thickness no greater than 5 mm.

5. The method of claim 1, wherein the golf club head comprises a loft angle no less than 18°.

6. The method of claim 1, wherein the golf club head comprises a volume no less than 50 cc.

7. The method of claim 6, wherein the golf club head comprises a volume no greater than 150 cc.

8. The method of claim 1, wherein the golf club head is an iron-type golf club head.

9. The method of claim 1, wherein the planar contact surface is a surface of a downwardly-engaging jaw of a golf club clamping device.

* * * * *